US005269165A

United States Patent [19]

Matsuoka

[11] Patent Number: 5,269,165

[45] Date of Patent: Dec. 14, 1993

[54] APPARATUS FOR MAKING COILED SPRINGS

[75] Inventor: Takeji Matsuoka, Tokyo, Japan

[73] Assignee: MEC Machinery Co., Ltd., Tokyo, Japan

[21] Appl. No.: 966,329

[22] Filed: Oct. 26, 1992

Related U.S. Application Data

[62] Division of Ser. No. 673,385, Mar. 22, 1991, Pat. No. 5,182,930.

[30] Foreign Application Priority Data

Mar. 30, 1990 [JP] Japan ..... 2-83245

[51] Int. Cl.[5] ..... B21F 3/10

[52] U.S. Cl. ..... 72/138; 72/452

[58] Field of Search ..... 72/138, 139, 450, 452

[56] References Cited

U.S. PATENT DOCUMENTS

| | | | |
|---|---|---|---|
| 3,402,584 | 9/1968 | Cavagnero | 72/138 |
| 3,427,838 | 2/1969 | Rimmer | 72/138 |
| 3,472,051 | 10/1969 | Bergevin | 72/138 |
| 4,594,869 | 6/1986 | Matsuoka | 72/135 |
| 4,991,277 | 2/1991 | Itaya | 29/173 |
| 5,025,648 | 6/1991 | Matsuoka | 72/134 |

*Primary Examiner*—P. W. Echols

*Attorney, Agent, or Firm*—Oblon, Spivak, McClelland, Maier & Neustadt

[57] ABSTRACT

A process for making coiled springs by intermittently rotating feed rollers with a wire held therebetween to feed the wire through a wire guide into engagement with a bending die at the outlet of the wire guide, thereby coiling the wire is provided, wherein as a follower of a cam unit moves toward the base circle of a pitch cam by the force of a spring, a pitch tool extends in an extending direction for pitching, and as the follower of the cam unit moves away from the base circle of the pitch cam against the force of the spring, the pitch tool is retracted in a retracting direction, whereby pitching is completed. The apparatus for practicing this process comprises a cam unit having a pitch cam, a connecting rod following a follower of the cam unit, a spring for exerting a spring force to engage the follower of the cam unit with the pitch cam, a pitch tool extendible through a pitching lever by the force of the spring to determine the pitch of the coiled spring to be formed, a spring for constantly exerting a spring force to retract the pitch tool, a stopper for independently restricting the pitch tool to the position to which it is extended or to its reference position, and a roller rotating mechanism for intermittently rotating feed rollers at a given angle in a certain direction, the rollers feeding a wire to a bending die positioned in front of the pitch tool.

7 Claims, 12 Drawing Sheets

APPARATUS FOR MAKING COILED SPRINGS

This is a division of application Ser. No. 07/673.385, filed on Mar. 22, 1991 now U.S. Pat. No. 5,182,930.

BACKGROUND OF THE INVENTION

1. Field of the Invention

The present invention relates to a method for making a coiled or helical spring by rotating feed rollers with a wire held therebetween to feed out the wire by a given length via a wire guide to bring it in engagement with a bending die for coiling, in which a pitching tool for limiting the pitch of the coiled spring is designed such that its amount of extension can easily be adjusted, thereby easily making variously shaped spiral springs of high quality, and to an apparatus suitable for carrying out such method.

2. Statement of the Prior Art

Typical coiled springs are compression helical springs broken down into two types, (a) a straight type, shown in FIGS. 13(*a*), and (*b*) a taper type varying in diameter, shown in FIG. 13(*b*). These compression spiral springs, now produced, are regulated in terms of the diameter of a coil, total number of turns, amount (and number) of the seat turn, free length, pitch and other factors, depending upon the purpose. Such compression helical springs have wide applications and so have to be produced in various types but in small quantities.

Such pitched compression spiral springs are produced exclusively by a bending die technique. According to this technique, feed rollers with a wire held between them are continuously rotated by given angles to feed out a wire by a predetermined length to bring it in engagement with a bending die, thereby making a coil. Used with this technique is an apparatus including a wire feed portion for rotating the feed rollers with the wire held between them by the given angles to feed out the wire by the given length continuously, a pitching tool operating portion for operating a pitching tool to limit the pitch of a coiled spring and a bending die operating portion for determining the diameter of the coiled spring.

The conventional apparatus will now be explained with reference to FIGS. 14 and 15 of the accompanying drawings.

FIG. 14 is an illustrative view showing the structure of the pitch tool operating portion, and FIG. 15 is an illustrative view showing a means for regulating the stroke of a segment gear adapted to rotate the feed rollers of the conventional apparatus.

The wire feeding portion of the conventional apparatus is of the structure wherein the rotation of a crank disk driven by a motor is transmitted to the feed rollers via a gear to feed out the wire held between the feed rollers. As illustrated in FIG. 15 by way of example, a roller 22*a*′ is held by a slide 33′ located in a radial movable manner on a crank disc 22′ fixed to a crank spindle 21′, and is moved and positioned by an adjust screw 34′. In operative association with the rotation of the crank disc 22′, the roller 22*a*′ is moved within a guide groove 32*a*′ provided in a segment gear 31′, whereby the segment gear 31′ is rocked, while its angle of rotation around its shaft 31*a*′ is limited to a given value, thereby providing a repeated rotation of a pinion 30 in mesh with the segment gear 31′. The force of rotation of the pinion 30 is transmitted to a one-way rotary shaft 28 via a one-way clutch 29 to rotate the feed roller via a gear (not shown) in one direction alone. It is noted in this connection that the angle of rocking of the segment gear 31′ is immediately proportional to the length of the wire fed out. In order to regulate the length of the wire fed out, it is required to restrict an angle defined by two tangential lines drawn from the center of the shaft 31*a*′, acting as the fulcrum of the segment gear 31′ adapted to move the roller 22*a*′ placed on the crank disc 22′ in its radial direction, to an orbit in which the roller 22*a*′ rotates around the axis of the crank spindle 21′. More specifically, the two tangential lines are drawn from the center of the shaft 31*a*′ to a circle a locus illustrated by the center of the roller 22*a*′. Therefore, if an angle defined between the two tangents is small, a length of the wire fed out is small because the segment gear 31′ is rotated at an angle proportional to the angle defined between the two tangents. It is then necessary to change the angle defined between the two tangents by moving the roller 22*a*′ toward or opposite the center of the crank spindle 21′ when it is necessary to change the length of the wire fed out.

As illustrated in FIG. 14, the portion for operating a pitch tool 17 includes an L-shaped pitching lever 14 pivotally fixed to the apparatus proper, which has the pitch tool 17 at one end. The pitching lever 14 always receives at one end a one-way moment of rotation from the force of a spring 15 and is fixed at the other end by a stopper 16′ for determining the position at which the pitching lever 14 is to be stopped. Then, a connecting rod 11′ is provided to rotate the pitching lever 14 against the force of the spring 15. Connected to a second lever 10′ including a stroke controlling block 10*a*′ caused to follow a main lever 2*a*′ of a follower 2′ of a cam unit 1′, this rod 11′ is vertically displaceable in FIG. 14. When, as shown in FIG. 14, the connecting rod 11′ is moved upwardly by the force of the spring 15 to bring the pitching lever 15 in abutment against the stopper 16′, the pitch tool 17 mounted on one end of the pitching lever 14 is so retracted to the reference position that the follower 2′ of the cam unit 1′ is spaced away from a pitch cam 4′. Thus, a the follower 2′ of the cam unit 1′ is pushed down by engagement with the pitch cam 4′, the connecting rod 11′ is moved so downwardly that the pitching lever 14 is rotated clockwise to thrust out the pitch tool 17. According to such an arrangement, the crank spindle 21′ for rotating the crank disc 22′ of the wire feeding portion rotates in synchronism with a cam shaft 3 to which the pitch cam 4′ of the cam unit 1′ of the pitch tool operating portion is fixed.

With such an apparatus, pitched helical springs have heretofore been produced by thrusting out the pitch tool 17, while the wire continuously fed out of the wire feeding portion by a given length is brought in engagement with the bending die.

The thus produced compression coiled spring is to be placed at each end on a horizontal and thus includes a so-called seat turn in close contact with the adjacent turn. The seat turn is provided to stabilize the coiled spring when placed on a horizontal, and usually comes in contact with a horizontal over about 3/4–4/5 of its length. In the process of the wire being coiled from the seat turn at a given pitch, the coil's end is brought in contact with the adjacent turn by an initial tension. Of importance to keep the coiled spring upright is that the coiled spring be formed such that its axis makes a right angle (hereinafter called the squareness of the seat turn) to a horizontal inclusive of the seat turn. The conventional technique for producing coiled springs with such apparatus as mentioned above, however, is too timeconsuming and laborious to vary the shape and size of straight or taper compression coiled springs in such items as total number of turns, amount (or number) of seat turns, pitch and the squareness of seat turns for various reasons to be described later. Thus, this technique is not only low in working efficiency but makes it difficult to make regulations depending upon the processes applied. What is more, arrangements for producing compression coiled springs of high accuracy take very much time.

(1) The amount of the seat turn of the coiled spring produced with the conventional apparatus, a schematic illustration of which is given in FIG. 14, is determined by an angle value found by subtracting an amount of an angle of the follower 2', while it is in engagement with the pitch cam 4', from an amount of an angle of the pitch cam 4' rotated from the time when wire feeding is initiated to the time when wire feeding is terminated. Explaining this with reference to the compression coiled spring to be produced having an increased pitch, the adjust screw 11*a'* which is a right-hand thread screw and is screwed into the upper end of the connecting rod 11' is first turned to let it down, thereby narrowing a space between the end of the pitching lever 14 having the connecting rod 11' inserted through it and the second lever 10'. In consequence, the position at which the follower 2' begins descending by engagement with the pitch cam 4' comes close to the base circle of the pitch cam 4' to increase a vertical displacement of the connecting rod 11', whereby the amount of the pitch tool 17 to be thrusted out is increased. Thus, there is an increase in an amount of the angle of the pitch cam 4' rotated while the follower 2' is in engagement with the pitch cam 4', but there is a decrease in the amount of the seat turn, correspondingly. In order to obtain the proper amount of the seat turn, say, about 4/5–¾ turn, it is thus required to regulate the positions of axially two-divided pitch cams 4' and 4' by loosening a lock nut provided on the cam unit 1'. However, this takes much time, since the operation should be suspended to repeat fine regulations. In order to obtain the proper amount of the seat turn without regulating the pitch cams 4' and 4', the following technique is proposed. According to this technique, the adjust screw 10*b'* is turned to move the stroke controlling block 10*a'* on the side of the fulcrum around which the second lever 10' rocks, so that the position at which the follower 2' begins descending by contact with the pitch cam 4' comes close to the base circle of the pitch cam 4', thereby increasing a vertical displacement of the connecting rod 11'. In this state, the adjust screw 11*a'* is turned left to delay the time when the pitching lever 14 is to be actuated, thereby returning the amount of the pitch tool 17 to be thrusted out to a given amount to obtain a given pitch and return the amount of the seat turn to the initial. Such regulation of the amount of the seat turn, however, still suffers from a disadvantage that the squareness of the seat turn is not precise. This is because the angle of rotation of the pitch cam 4' is so unvaried in the process of the seat turn pitch changing to a given pitch that the rates of the pitch tool 17 thrusted out and retracted, while the seat turn pitch changes to a given pitch, are rapider than they were before the regulation. In most cases, the positions of the pitch cam 4' and 4' should finally be re-regulated.

When the pitch of the coiled spring to be produced has a decreased pitch, the adjust screw 11*a'* is turned left to let it up, thereby enlarging a space between the end of the pitching lever 14 having the connecting rod 11' inserted through it and the second lever 10'. In consequence, the position at which the follower 2' begins descending by contact with the pitch cam 4' is spaced away from the base circle of the pitch cam 4', so that the vertical displacement of the connecting rod 11' is decreased to decrease the amount of the pitch tool 17 in thrusting out. This also gives rise to a phenomenon similar to that associated with the coiled spring having an increased pitch.

When the wire to be used to produce the coiled spring varies in length, there is a variation in the amount of the seat turn. Briefly, the reason is that since the angle of rocking of the segment gear 31' varies, the times at which wire feeding is to be initiated and terminated vary with respect to the pitch cam 4' of the cam unit 1' rotated in synchronism with the crank disc 22' for rocking the segment gear 31'. This will be explained later in greater detail. As a matter of course, it is then required to regulate the amount of the seat turn by such means as mentioned above. Thus, the results of regulations of length of the wire fed out (the total number of turns), amount and squareness of the seat turn, the pitch, etc. have mutual contradictory influences upon the shape and size of the coiled spring to be produced, resulting in frequent re-regulations. In addition, the operation should be suspended whenever each regulation is carried out. The reasons are that (1) the positions of the pitch cams 4' and 4' and the angle of reciprocation of the segment gear 31' for varying the length of the wire fed out should be regulated within the apparatus, and the adjust screw 10*b'* is positioned at a distance about three times as large as the distance from the fulcrum of the second lever 10' to the junction of the connecting rod 11'. Such regulations are much laborious and need skillfulness since they are carried out on the basis of workers' intuition.

(2) The length of the wire fed out to produce the coiled spring is varied by regulating an amount of the angle of reciprocation of the segment gear 31'. As already mentioned, this angle is defined by two tangential lines drawn from the shaft 31*a'* that is the fulcrum of the rocking segment gear 31' to an orbit in which the roller 22*a'* rotates around the axis of the crank spindle 21'. In association with the regulation of the position of the roller 22*a'*, there is a variation in the time at which the rate of the segment gear 31' is zero with respect to the rotation of the crank disc 22', i.e., in the time when wire feeding is to be initiated or terminated. Also, that time varies with respect to the rotation of the pitch cam 4' rotating in unison with the crank disc 22' and, hence, with respect to the time when the pitch tool 17 is to be thrust out or retracted, so that any proper length of the seat turn cannot be obtained. Thus, it is required to re-regulate the amount of the seat turn by such means as mentioned above.

(3) The wire used to produce the coiled spring is of an elastic and plastic material. For pitching, it is required to thrust out the pitch tool 17 excessively so that the pitch of the desired coiled spring is slightly exceeded to accommodate to springing-back. However, during the transition from the leading seat side of a coil to a given pitch, coiling takes place, while the pitch tool 17 is thrust out as the follower 2' is moved away from the base circle of the pitch cam 4' along the outer periphery of the pitch cam 4'. During the transition from a given pitch to the trailing seat turn of the coil, coiling takes place, while the pitch tool 17 is retracted as the follower 2' is moved toward the base circle of the pitch cam 4' along the outer periphery of the pitch cam 4'. Although the conditions are quite contradictory to each other in this manner, it is required to make use of the pitch cam 4' shaped following the curvature change required to prevent a jumping-up of the follower 2'. This makes it impossible to effect both the extension and retraction of the pitch tool 17 at a uniform speed. Besides, there is only a set of the main lever 2a' and second lever 10' etc. having direct relation to the squareness of the seat turn. In most cases, therefore it is very difficult to impart a correct squareness to each seat turn of a compression spiral spring. For that reason, a plurality of pitch cams 4' differing in outer curvature are provided as reference pitch cams. In most cases, however, said pitch cams 4' are unserviceable for the desired compression coiled spring, since such compression springs are of different pitches, diameters of coils, materials thereof etc. and they are varied in types. In such cases, the outer periphery of the pitch cam 4' is repeatedly cut as by a hand grinder to correct the outer curvature of the pitch cam 4'. However, such a pitch cam 4' only serves as an exclusive cam for the next arrangements.

When producing such a taper compression spiral spring as shown in FIG. 13(*b*), various regulations for obtaining such proper seat turns as mentioned above are more laborious than those required for straight compression spiral springs, since there is an increase in the amounts of both the seat turns because they differ in the diameters thereof. In the case of forming compression spiral springs, a suitable initial tension is usually applied to the ends of a coil in order to stabilize the seat turns and a free length. Because the greatest outer diameters of the pitch cams 4' and 4' are shaped to contours having the same radii and the pitch tool 17 is extended by a given amount to a given position, such a taper compression coiled spring as shown in FIG. 13(*b*) has a pitch decreased under the influence of the initial tension applied to the coil ends, as the coil diameter is increased. Pitching for obtaining the theoretical load characteristics originally required takes much time.

(4) A wire formed of a material for coiled springs by cold drawing cannot always be formed into a compression coiled spring of the desired shape and size even with an exclusive cam for the next arrangements, since there is a variation in the material properties. It is then required to provide repeated regulations of such parts as mentioned above. Even though the compression spiral spring of the desired shape and size can be formed with said exclusive cam, it would likewise take much time to replace the two-split type of pitch cams 4' and 4' and to position them.

SUMMARY OF THE INVENTION

In view of the defects of the prior art, an object of the present invention is to provide a process and apparatus for making coiled springs, which can produce variously pitched compression spiral springs such as straight or taper compression spiral springs with only one pitch cam and without replacing a pitch cam for operating a pitch tool; can simply and accurately correct and regulate the amounts of the leading seat turns of these compression coiled springs, the squarenesses of the leading seat turns, the squarenesses of the trailing seat turns of the coils having a predetermined pitch and the amounts of the trailing seat turns without interfering with the shape and size of the coiled springs in a contradictory state; can effect the above-mentioned various adjustments and vary the length of a wire to be continuously fed out by a given distance, during formation of coiling, thereby forming spiral springs of a higher precision with higher production efficiency.

BRIEF DESCRIPTION OF THE DRAWINGS

The method for making coiled springs according to the present invention will now be explained in greater detail with reference to the apparatus for making coiled springs, which is suitable for carrying out that method, illustrated in the accompanying drawings given by way of example alone, in which.

DETAILED EXPLANATION OF THE PREFERRED EMBODIMENTS

The coiled spring-making apparatus suitable for carrying out the method according to the present invention will now be explained in greater detail.

Figure 1:
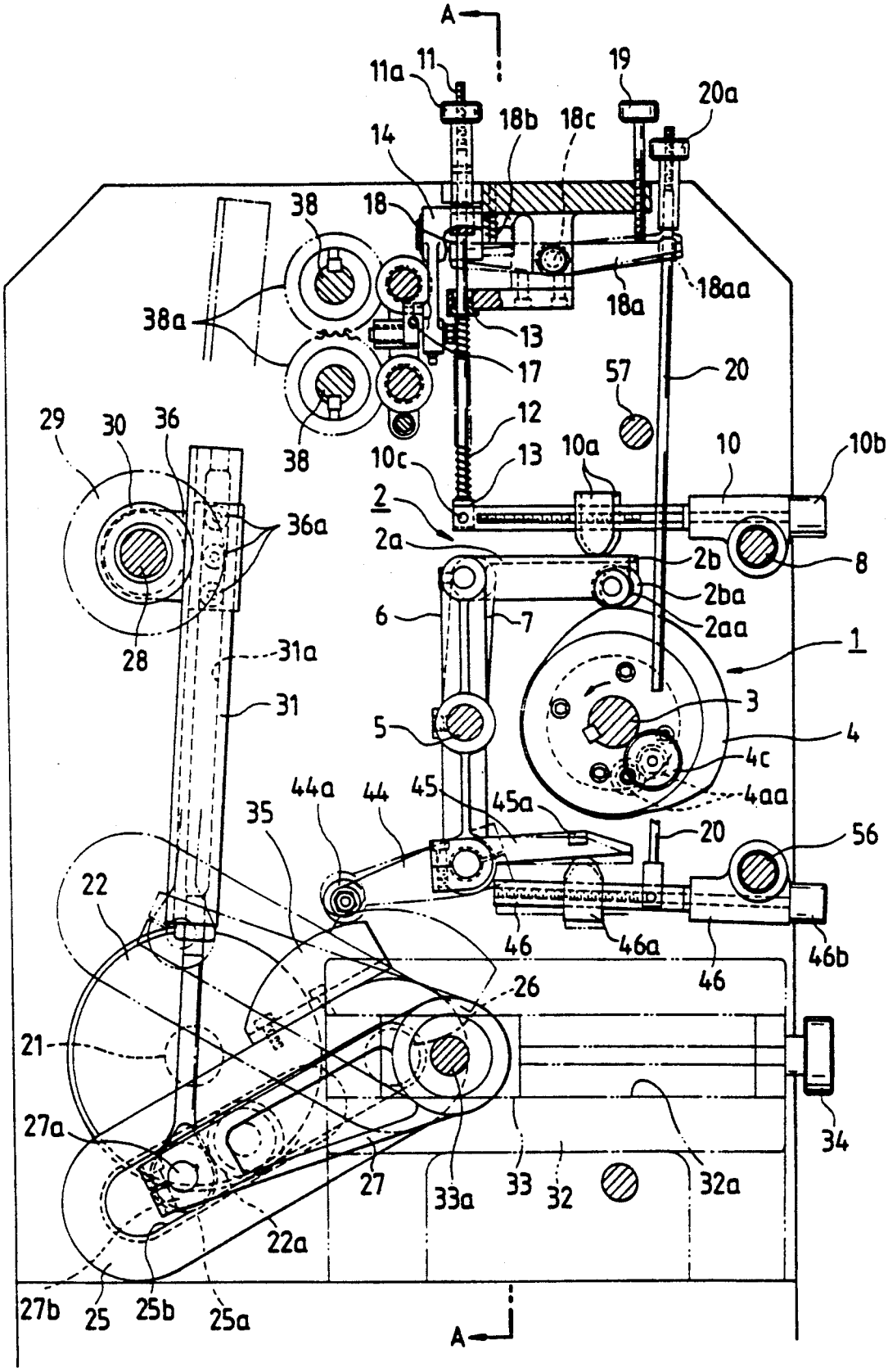
FIG. 1 is a front section illustrating part of one embodiment of the coiled spring-making apparatus suitable for carrying out the method according to the present invention.
Figure 5:
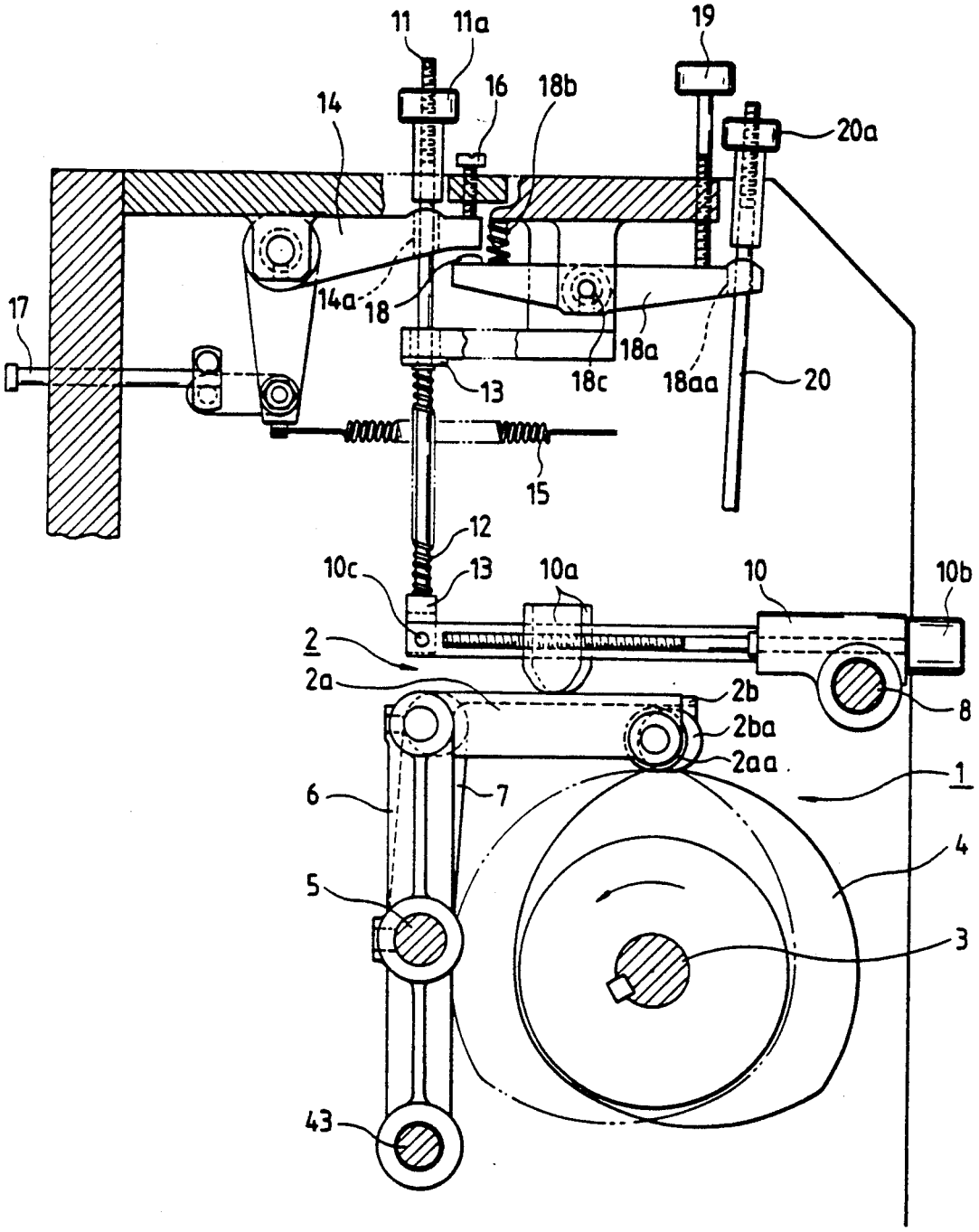
FIG. 5 is a view illustrative of the principles of the pitch tool work in operative association with the operation of the cam means.
Figure 6:
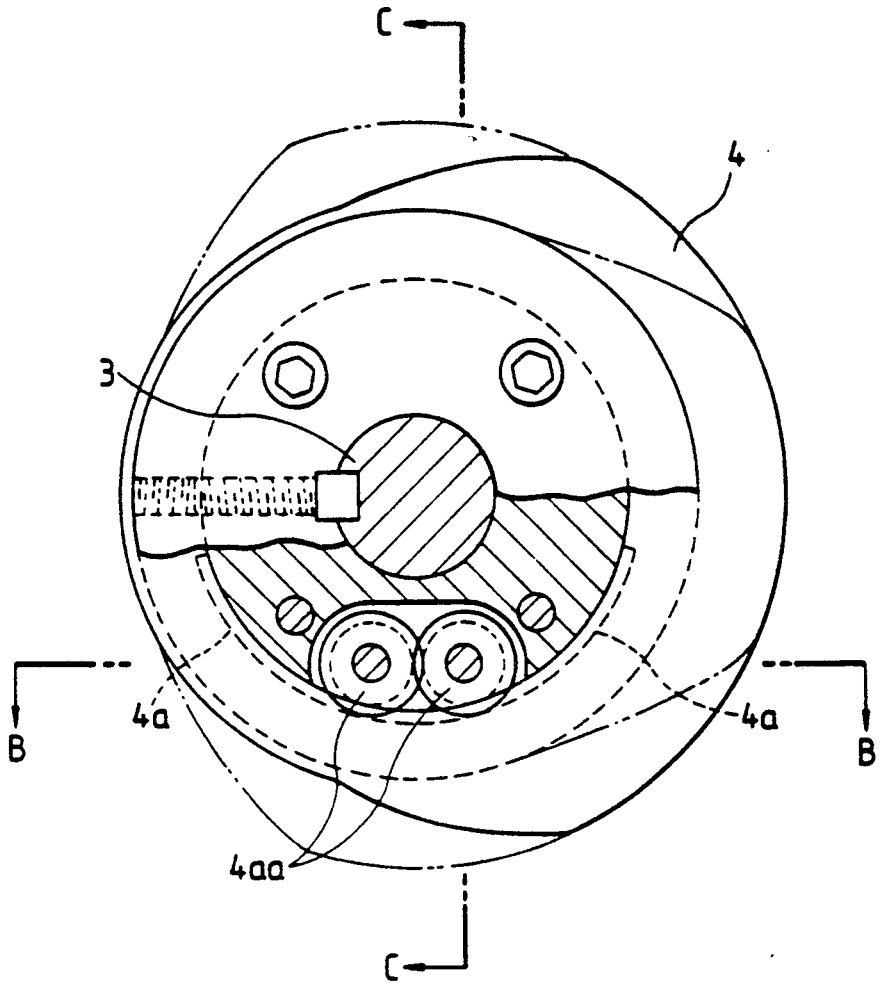
FIG. 6 is a partly sectioned, enlarged front view illustrating the structure of the pitch cam divided into two portions and including a differential mechanism.
Figure 7:
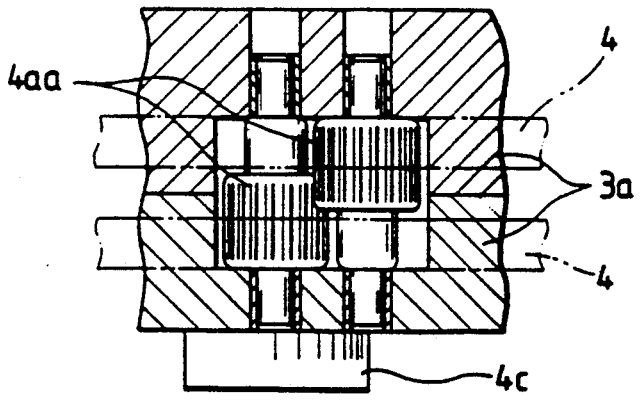
FIG. 7 is a sectional view taken along the line B—B of FIG. 6.
Figure 8:
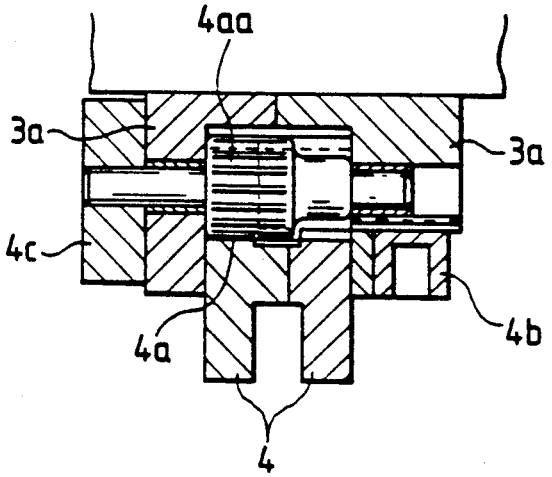
FIG. 8 is a sectional view taken along the line C—C of FIG. 6.
Figure 9:
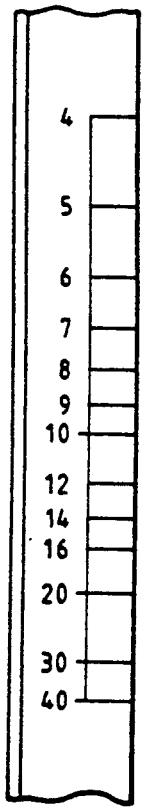
FIG. 9 is an exploded view of a graduated dial for showing the effective number of turns of the coiled spring produced, which is adjusted by a differential mechanism when using the pitch cam shown in FIG. 6.
Figure 12:
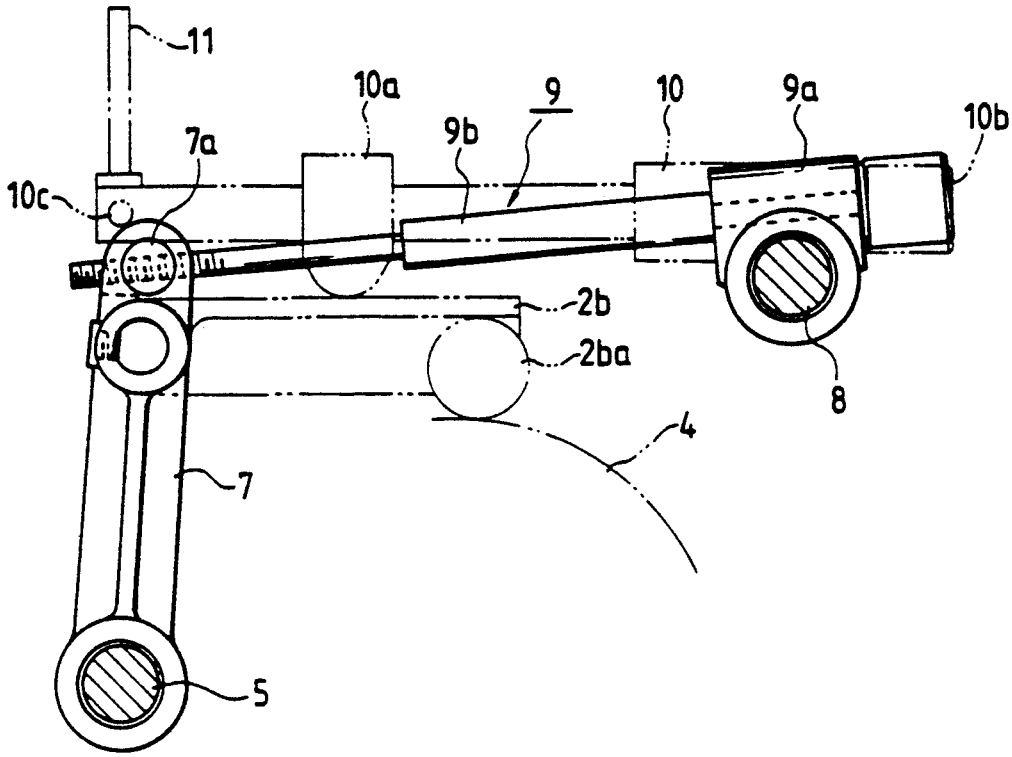
FIG. 12 is a view illustrating means for adjusting the position of one of two-divided followers in a cam unit.
Figure 13A:
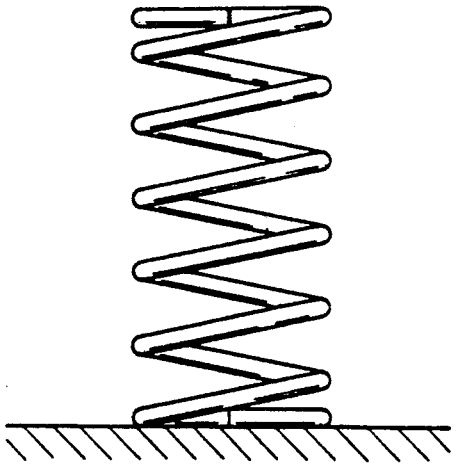
FIGS. 13A and 13B are views showing a straight compression coiled spring (FIG. 13A) and a taper compression coiled spring (FIG. 13B), both pitched.
Figure 13B:
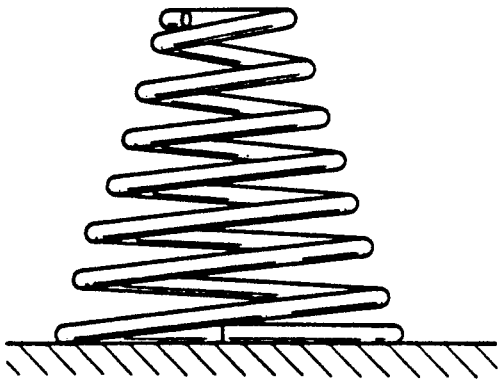
Figure 14:
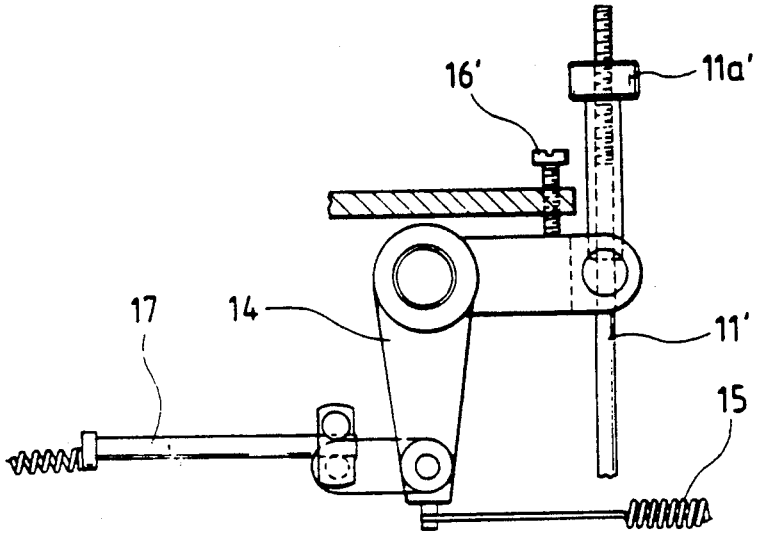
FIG. 14 (PRIOR ART)
FIG. 14 is a view illustrating the structure of a pitch tool operating portion for operating a pitch tool in conventional apparatus.
Figure 14:
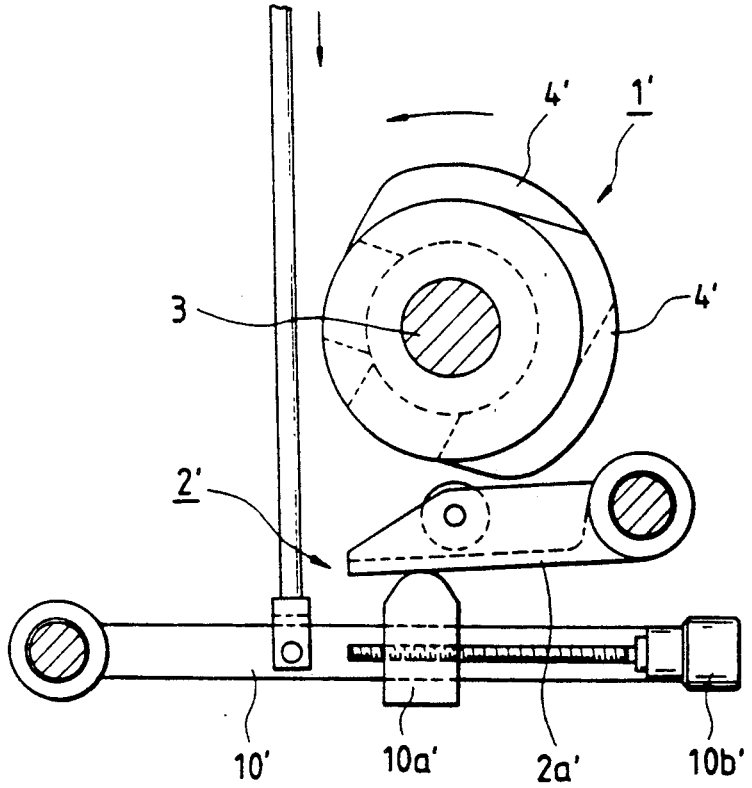
FIG. 14 (PRIOR ART)
Figure 15:
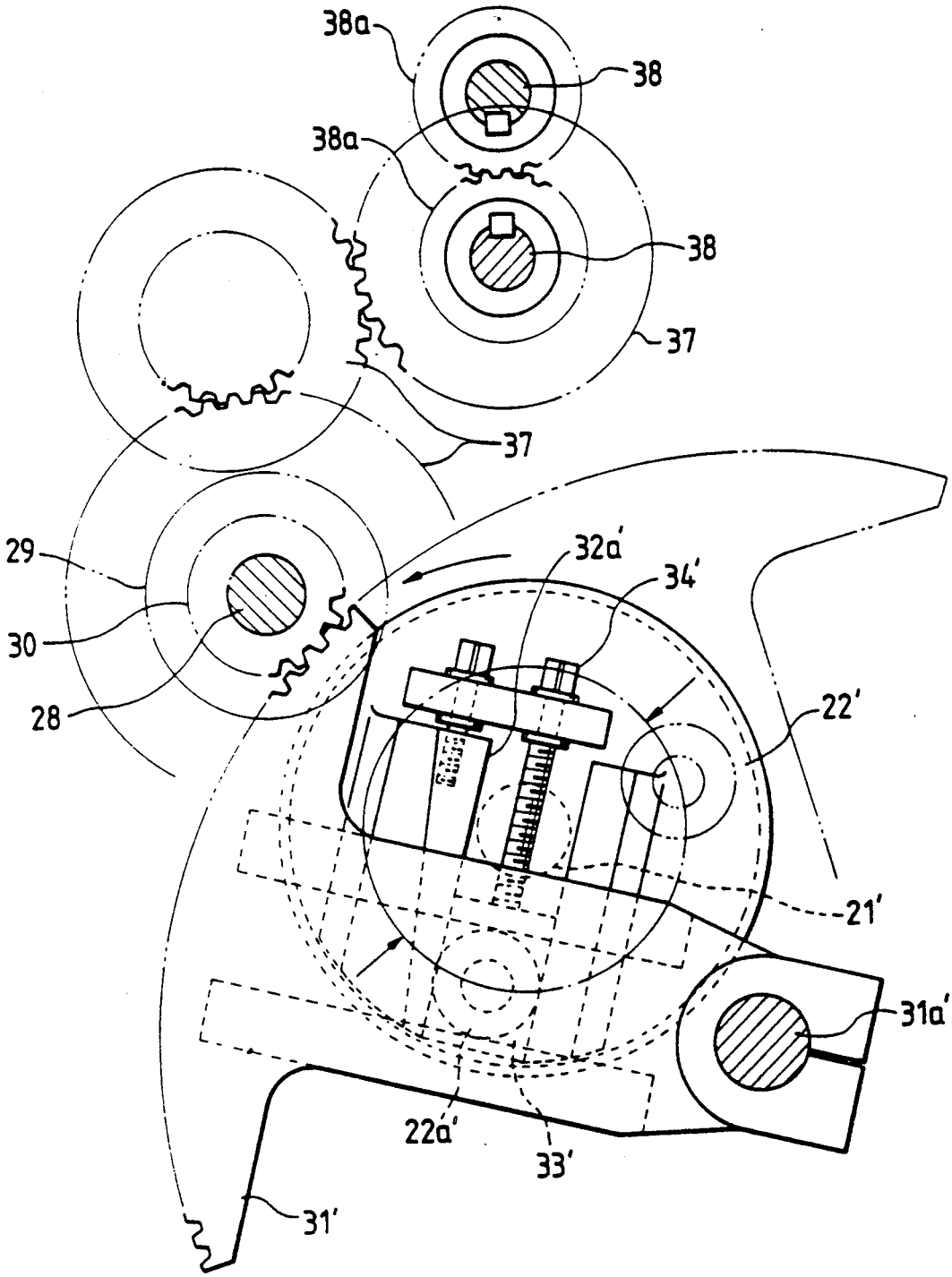
FIG. 15 (PRIOR ART)
FIG. 15 is a view illustrating means for adjusting the stroke of a segment gear for rotating feed rollers in the conventional apparatus.

A cam unit, shown at 1, comprises a pitch cam 4 fixed to a cam shaft 3 attached to a main body of the apparatus and a follower 2 engaging the outer periphery of the pitch cam 4 for rocking movement. It is desired that the pitch cam 4 of the unit 1 be of large width, or it is better to be divided into two parts in the axial direction of the cam shaft 3, since the momenta of the follower 2, a connecting rod 11, an adjust screw 11*a*, etc. can then be reduced for the reason set forth later. In either case, the follower 2 should preferably work following a uniform circular motion curve. When the pitch cam 4 is divided into two parts, it is preferred that the parts of the pitch cam 4 are provided with internal gears 4a, as shown in FIGS. 6–8, which bring pinions 4aa in mesh with each other, said pinions being supported on both sides by a cam holder 3a fixed to the cam shaft 3, so that the contour of the pitch cam 4 can easily be varied only by the operation of one pinion 4aa. This in turn makes it possible to change the timing when the follower 2 is to follow the pitch cam 4 in correspondence to the total number of turns of the compression coiled spring to be produced. One of the pinions 4aa to be operated at this time is fixedly provided with an adjusting knob 4c for regulating the location of the pitch cam 4. Preferably, this adjusting knob 4c is calibrated, as shown in FIG. 9, so as to preset the effective number of turns of the coiled spring to be produced. Moreover, the pitch cam 4 is provided with a lock nut 4b to fix the location of the pitch cam 4 adjusted by the adjusting knob 4c, as illustrated in FIG. 8. The pitch cam 4 of the cam unit 1 shown in FIGS. 1 and 5 is designed to rotate counterclockwise. Engaging the outer periphery of the pitch cam 4 of the cam unit 1, the follower 2 includes a main lever 2a having a cam follower 2aa at its extreme end and rotatably supported by the main body of the coiler. As shown in FIGS. 1 and 5, the main lever 2a, for instance, may be rockingly supported around the upper end portion of a strut 6 fixed substantially at its center to a shaft 5 fixed to the main body of the coiler. Another main lever 2b includes at its extreme end a cam follower 2ba to engage the outer periphery of the pitch cam 4, and is rockingly supported at one end (the upper end in FIGS. 1 and 5) of an arm 7 rotatably mounted at the other end on the shaft 5, while it is located adjacent to the first main lever 2a. The cam followers 2aa and 2ba of the main lever 2a and 2b are engaged with the outer periphery of the pitch cam 4 immediately above the cam shaft 4 in the embodiment illustrated in FIGS. 1 and 5. Then, as illustrated in FIG. 12, adjusting means 9 is provided for adjusting a variation in the time when the cam follower 2ba of the second main lever 2b is to be engaged with the outer periphery of the pitch cam 4. In a normal state, the second main lever 2b is preset ahead of the first main lever 2a in the time of engagement. One reason is that when the main levers 2a and 2b are driven along the profile of the pitch cam 4 from its outer periphery toward its reference pitch circle (downwardly in FIGS. 1 and 5) or a pitch tool 17 projects out, the main lever 2a works behind the main lever 2b, so that a second lever 10 can follow the main lever 2a. Another reason is that when the main levers 2a and 2b are spaced away from the reference pitch circle along the profile of the cam pitch 4 (upwardly in FIGS. 1 and 5) or the pitch tool 17 retracts, the main lever 2b is moved ahead of the main lever 2a so that the main lever 2b can follow the second lever 10. In this manner, it is possible to independently regulate the squareness of the turns of the leading and trailing ends of the coiled spring to be produced. As illustrated in FIG. 12, a pin 7a fitted into an upper end portion of the arm 7 is provided with a threaded hole, into which an adjust screw 9b is to be threadedly inserted. The screw 9b, as illustrated, is then held by a block 9a pivotally provided to a shaft 8 secured to the main body of the apparatus.

Reference numeral 10 stands for two second levers connected at their extreme ends with each other by a pin 10c and pivotally provided to the shaft 8 secured to the main body of the apparatus. They are located in correspondence to the main levers 2a and 2b of the follower 2 of the above-mentioned cam unit 1. Abutting upon the main levers 2a and 2b, stroke controlling blocks 10a are positioned for slidable displacement in the longitudinal direction of the second levers 10. Adjust screws 10b for adjusting the positions of the stroke controlling blocks 10a and 10a are provided into the stroke controlling blocks 10a and 10a abutting upon the main levers 2a and 2b. It is then preferable that the second levers 10 are located parallel with the main levers 2a and 2b while the cam followers 2aa and 2ba of the main levers 2a and 2b abut upon the outer peripheries of the pitch cams 4 and 4 having the same radius. This is because the second levers 10 are unlikely to move vertically, even when the stroke controlling blocks 10a and 10a move.

Reference numeral 11 stands for a connecting rod having an adjust nut 11a threadedly inserted into its extreme end, which is connected to the second levers 10, with the above-mentioned pin 10c being inserted in it; 12, a spring for exerting a spring force to engage the follower 2 of the cam unit 1 with the pitch cam 4; and 14, an L-shaped pitching lever pivotally attached to the main body of the apparatus. The lever 14 is provided at its one end with a through-hole 14a with the connecting rod 11 inserted in it and at its other end with a pitch tool 17 for determining the pitch of the compression coiled spring to be produced. Normally exerting a spring force to retract the pitch tool 17, a spring 15 (a tension coiled spring in the embodiment illustrated in FIGS. 2, 5 and 10) is attached at its both ends to the main body of the apparatus and the pitching lever 14. The spring 12 is a compression coiled spring which exerts a spring force in the said direction to engage the follower 2 of the cam unit 1 with the pitch cam 4, as mentioned above. By way of example, in the embodiment illustrated in FIGS. 1, 2, 5, 10, the compression coiled spring is used. As illustrated, the compression coiled spring 12, which is guided by the connecting rod 11, is compressed between one spring seat 13 provided on the connecting rod 11 and another spring seat 13 secured to the main body of the apparatus to exert a spring force. This coiled spring is then designed to produce a spring force 2–3 times as much as that exerted by the spring 15.

A stopper 16 is provided to limit the reference position of the pitch tool 17 for limiting the pitch of the compression coiled spring to be produced, i.e., the position of the pitch tool 17 for forming the leading turn of the coiled spring with a suitable initial tension. In other words, it serves to limit the position of the pitching lever 14 tending to turn to retract the pitch tool 17 by the spring force of the spring 15. In order to adjust that position, the stopper 16 is provided with a threaded portion to be threadedly inserted into the main body of the apparatus.

Figure 2:
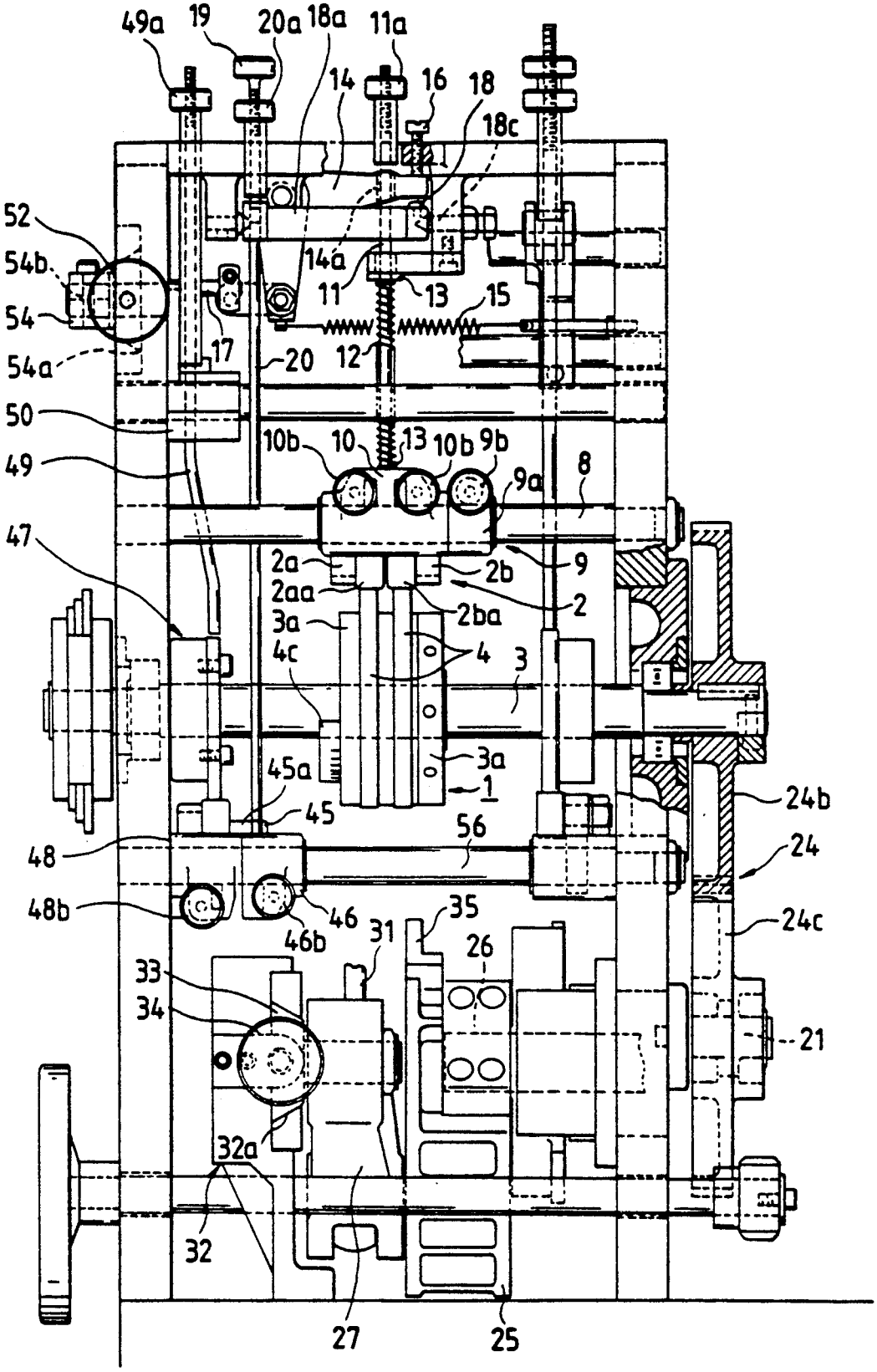
FIG. 2 is an illustrative right side view of that apparatus.

A stopper 18 is provided to limit the extension of the pitch tool 17 for determining the pitch of the coiled spring to be produced. As is the case with the stopper 16, the stopper 18 may be threadedly inserted into the main body of the apparatus to abut directly upon the pitching lever 14, thereby limiting the position at which the pitching lever 14 turns to extend the pitch tool 17. As illustrated in FIGS. 1, 2 and 5, however, it is preferred in consideration of operability that the stopper is of such a structure that it is fixedly joined at its central position to one end of a stopping lever 18a pivotally attached to a shaft 18c secured to the main body of the apparatus in such a way that it is located below the orbit of movement of one end of the pitching lever 14 and is engaged at its other end by way of the spring force of a spring 18*b* with an adjust screw 19 which is threadedly inserted into the main body of the apparatus. When the connecting rod 11 is pushed down by the force of the compression coiled spring 12, the pitching lever 14 is turned by the adjust screw 11*a* in threaded engagement with the connecting rod 11, thereby extending the pitch tool 17 from the reference position. The amount of the projection is then limited by the position of the stopping lever 18*a* positioned by the adjust screw 19. When the projection of the pitch tool 17 (pitching) is initiated and when it is returned to the reference position (pitching is terminated) are determined by a distance between the lower end of the adjust screw 11*a* and the upper end of the through-hole in the pitching lever 14, while the amount of the turns of both ends of the compression spiral spring to be produced is limited. If the compression spiral spring to be produced is large in the total number of turns, the amount of the leading and trailing seat turns is then small relative to the total number of turns. For that reason, the position of the follower 2 to abut upon the pitch cam 4 is so spaced away from its base circle that the momenta of the connecting rod 11, adjust screw 11*a* and second levers 10 can be decreased. By contrast, if the coiled spring to be produced is small in the total number of turns, the amount of the leading and trailing seat turns is then large relative to the total number. For that reason, the position of the follower 2 to abut upon the pitch cam 4 is so close to its base circle that the momenta of the connecting rod 11, adjust screw 11*a* and second levers 10 can be increased. Thus, increased momenta of the follower 2 and the linkage mechanism reduce the production rate of machinery of relatively large size. Accordingly, no problem arises at all, even if the pitch cam 4 is formed of one material, as shown in FIG. 5. However, if coiled springs having a limited number of turns are produced with machinery of relatively small size, then the rate of production should often be increased. An increased rate of production generates a hideous noise, giving workers a feeling of uneasiness. When producing coiled springs with machinery of relatively small size, it is therefore preferred that the pitch cam 4 is axially divided into two parts, as shown in FIGS. 6–8, so that they can be moved to given positions in the opposite direction by turning an adjusting knob 4*c* calibrated corresponding to the effective number of turns, thereby enabling the follower 2 to abut constantly upon the pitch cam 4 at a position close to its periphery for pitching.

Located in front of the thus operated pitch tool 17 is a bending die. A wire material is supplied to the bending die by a feed roller rotated in a certain direction and intermittently through given angles by a feed roller rotating mechanism, which will now be explained just below.

Power from a power source such as a motor (not shown) is transmitted via a power transmission mechanism 23 to a main crank shaft 21 attached to the main body of the apparatus, thereby rotating it. In the embodiment illustrated in FIG. 1, it is rotated counterclockwise. A crank disk 22 is fixed to the end of the main crank shaft 21 at right angles with respect to its axis. A roller 22*a* is rotatably mounted on the crank disk 22 at a position spaced away from the axis of the crank shaft 21 by a given distance.

Figure 4:
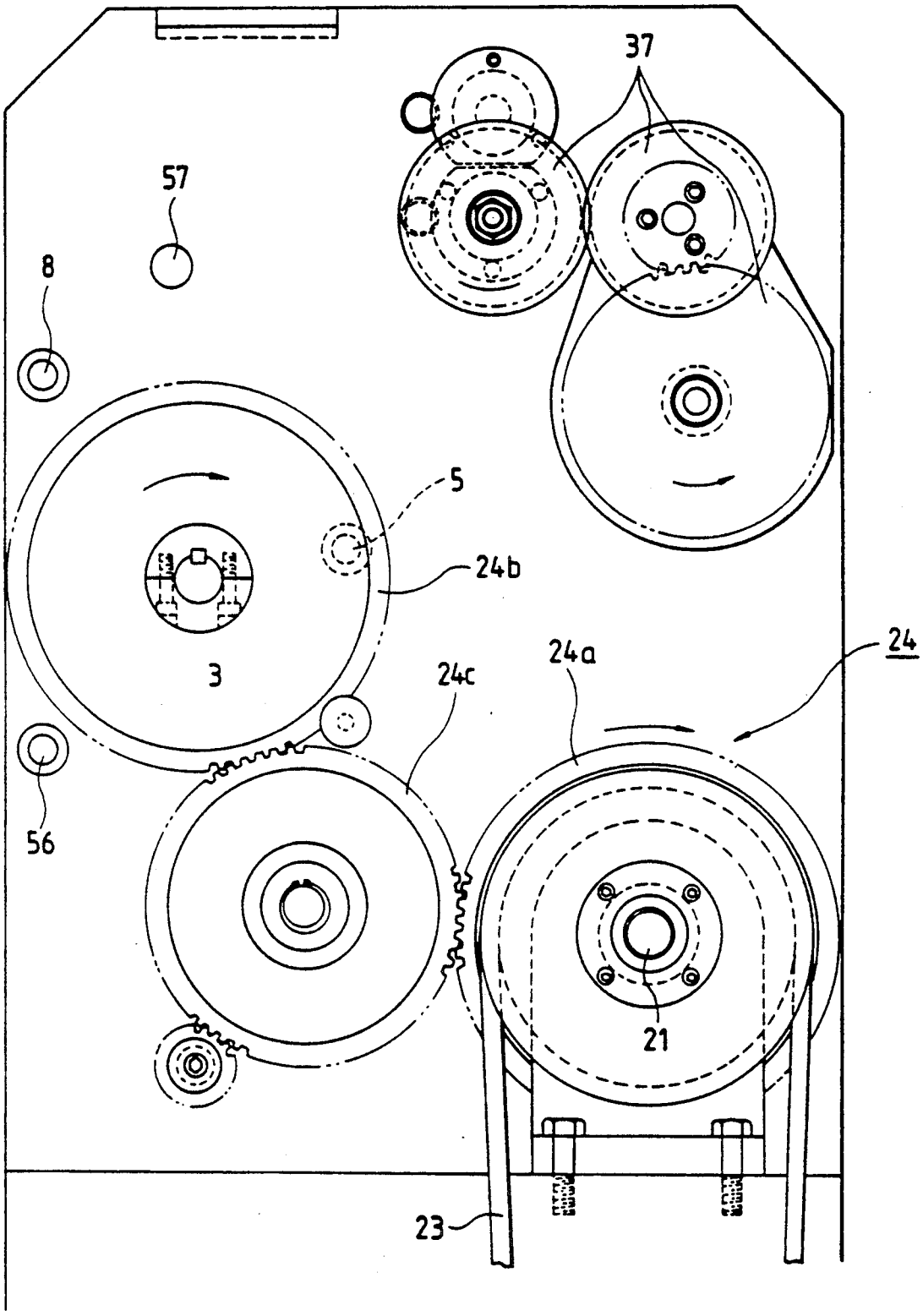
FIG. 4 is an illustrative rear view of that apparatus.

A gear unit generally shown at 24 is provided in place to transmit the rotational force of the crank shaft 21 to the cam shaft 3 of the cam unit 1. In order to rotate the cam shaft 3 in synchronism with the crank shaft 21, the gear unit 24 is fixed to the cam shaft 3 in such a way that a gear 24*a* fixed to the crank shaft 21 meshes with a gear 24*b* having the same number of teeth as that of the gear 24*a* through an intermediate gear 24*c*, as illustrated in FIG. 4.

Figure 3:
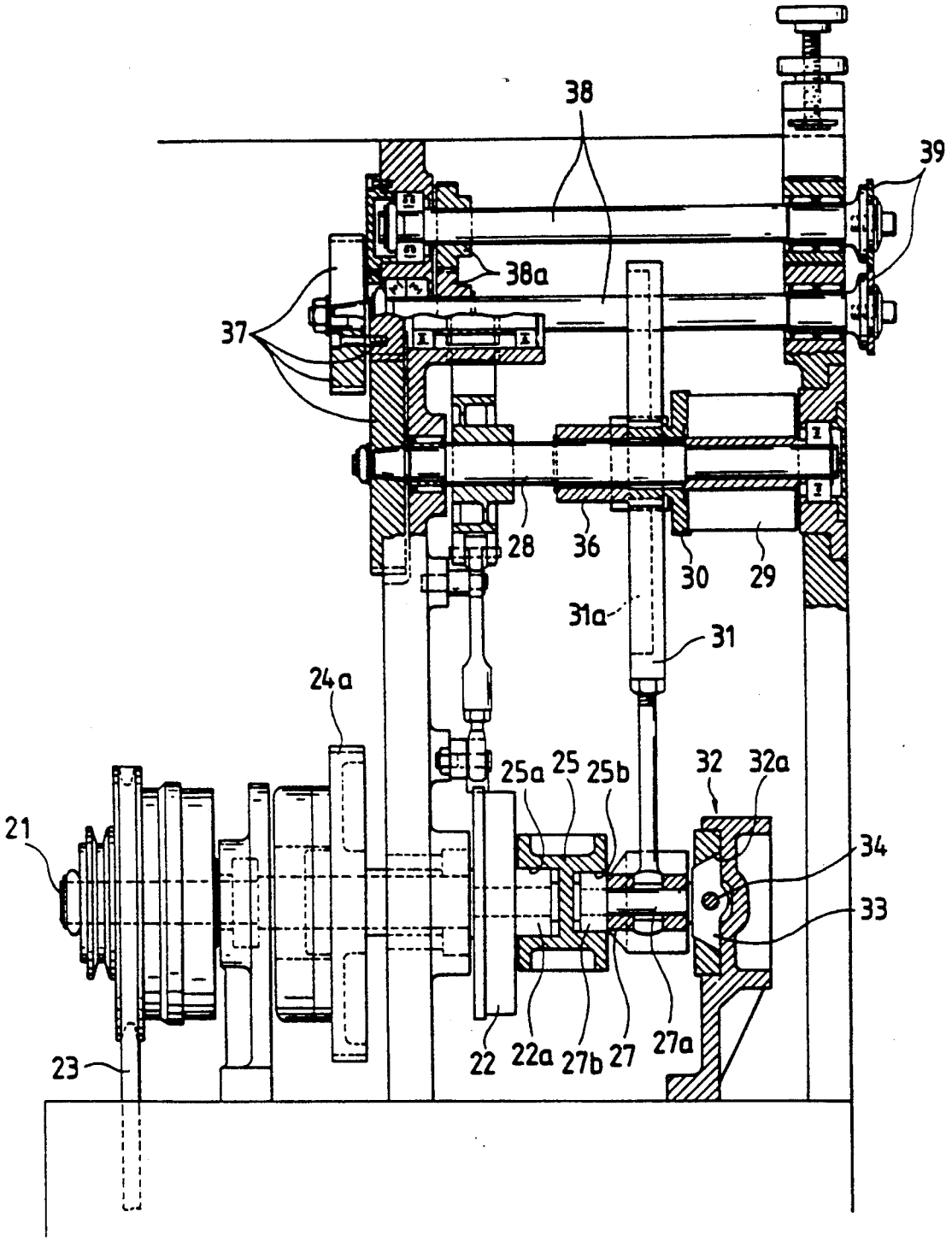
FIG. 3 is an illustrative left side view of that apparatus.
Figure 11:
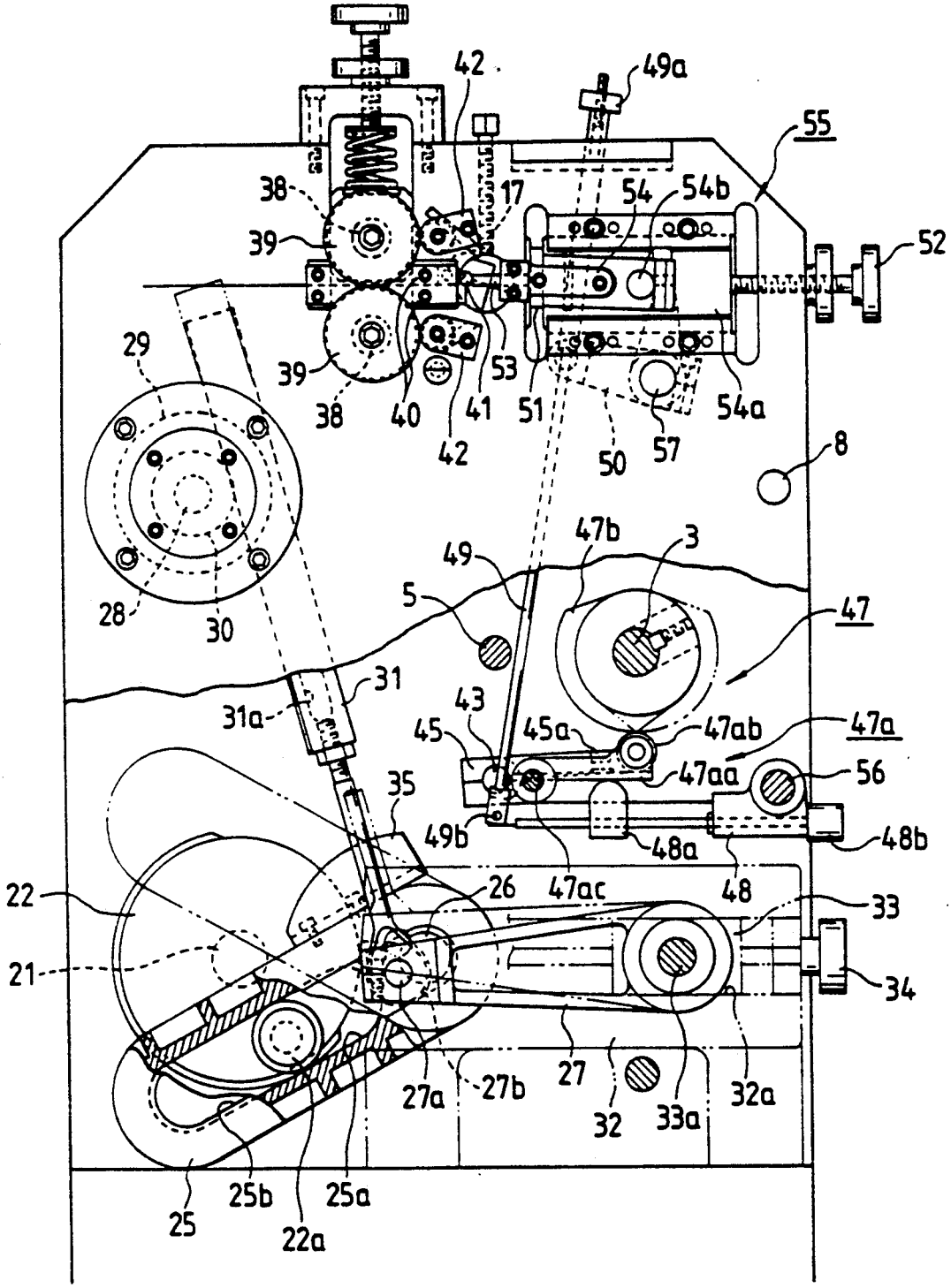
FIG. 11 is a partly sectioned, front view illustrating a bending die mechanism in the embodiment of FIG. 1.

A rocking lever 25 is pivotally mounted on a support shaft 26 having its axis located parallel with the axis of the main crank shaft 21 at a position spaced away from the axis of the main crank shaft 21 by a given distance, and is rockable around the support shaft 26 in a given angular range by the rotational movement of the roller 22*a* around the main crank shaft 21 of the crank disc 22. As shown in FIGS. 1, 3 and 11, the rocking lever 25 is provided on its one side with a guide groove 25*a* in engagement within the roller 22*a* rotatably mounted on the crank disk 22 and on its opposite side with a guide groove 25*b*, both grooves being formed along the normal direction of the axis of the support shaft 26. Received in one groove 25*b* is a roller 27*b* rotatably fitted over the end of a shaft 27*a* fixed to an extreme end of a second lever 27, as will be described later. The shaft 27*a* is pivotally provided with one end of a rack 31 to be described later, thereby defining the fulcrum of the rack 31.

The second lever 27 is pivotally attached to a shaft 33*a* provided on a slide 33 slidably supported in a guide groove 32*a* in a slide unit 32 in such a way that it is movable toward or away from the support shaft of the rocking lever 25, and serve to support the rack 31 and move its fulcrum along the guide groove 25*b* in the rocking lever 25. In order to maximize the stroke of the rack 31, it is preferable that the slide unit 32 is provided with a guide groove 32*a* in such a way that the axis of the second lever 27 is movable on a line connecting the axis of the main crank shaft 21 with the axis of the support shaft 26. The slide unit 32 is provided with an adjust screw 34 for sliding the slide 33. In other words, the rack 31 supported by the second lever 27 works at a given stroke, following the rocking lever 25 constantly rocking at a given angle. If the adjust screw 34 is turned to move the shaft 33*a* of the slide 33, then the roller 27*b* defining the fulcrum of the rack 31 moves to a given position in the guide groove 2*b* in the rocking lever 25 rocking around the support shaft 26. Thus, the stroke of the rack 31 can be freely adjusted whether the apparatus is in operation or not. In the embodiment illustrated, it is noted that while the shaft 33*a*, around which the second lever 27 rocks, is positioned on the opposite side of the crank shaft 21, as viewed from the support shaft 26, it may be positioned on the same side of the main crank shaft 21, as viewed from the support shaft 26.

A rack 31 meshes with a pinion 30 fixed to a one-way clutch shaft 29 for transmitting rotation in one direction alone to a one-way rotary shaft 28 pivotally attached at one end to the extreme end of the second lever 27 and rotatably attached at the other end to the main body of the apparatus. In order to ensure the mesh of the rack 31 with the pinion 30, it is preferable that a guide block 36 including a roller 36*a* is pivotally attached to the one-way rotary shaft 28 at a position spaced away from its axis by a given distance and the rack 31 is provided with a guide groove 31*a* to engage the roller 36*a* of the guide block 36.

Otherwise, the present apparatus is substantially similar to the conventional apparatus. However, two feed roller shafts 38 rotatably attached to the main body of the apparatus are provided with feed rollers 39 for holding the wire therebetween. One feed roller shaft 38 (one located below in FIG. 3) is fixedly provided with a gear 37 at its end on the opposite side of the feed roller 39. Via the gear 37, the rotation of the one-way rotary shaft 28 is transmitted to the feed roller shafts 38, so that the rotation transmitted to the feed roller shaft 38 (one located below in FIG. 3) via each gear 38*a* fixed to each feed roller shaft 38 is transmitted to the other feed roller shaft 38 (one located above in FIG. 3) to rotate the feed roller shaft 38 and, at the same time, to rotate the feed roller 39 fixed at the end of the feed roller shaft 38. Reference numeral 40 denotes a wire guide for guiding a wire held between the feed rollers 39; 41, a core; and 42, a cutting shaft fixedly provided with a cutter for cutting the coiled wire to the required length.

Preferably, stopper moving means to be described just below is provided, including a stopping lever 18*a* which is reciprocated in synchronism with the rocking lever 25 adapted to rock the stopper 18 for limiting the extension of the pitch tool 17 through a given angle by the rotation of the main crank shaft 21 of the feed roller rotating mechanism, as shown in FIGS. 1, 2 and 5.

Figure 10:
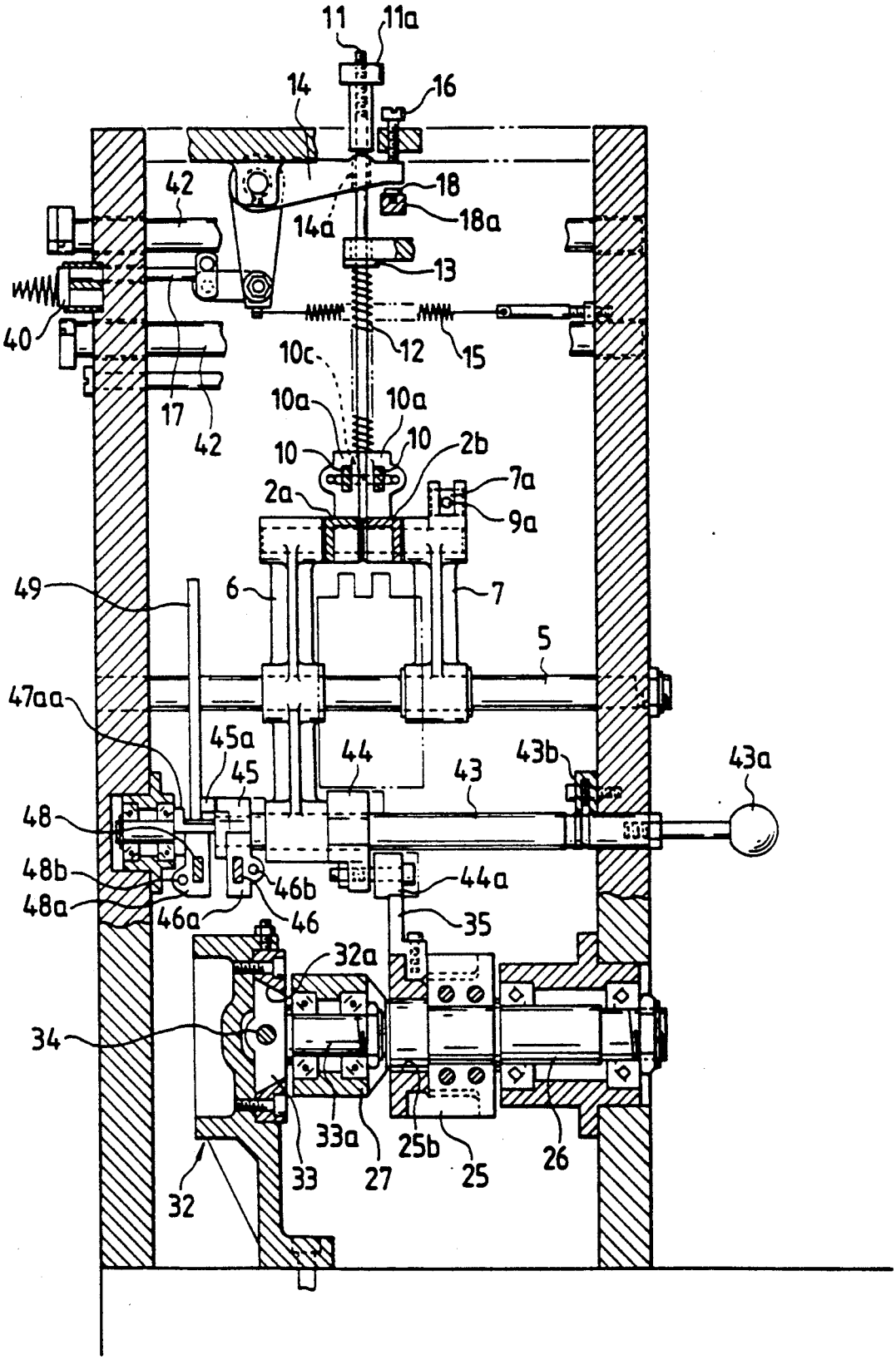
FIG. 10 is an illustrative sectional view taken along the line A—A of FIG. 1.

A taper cam 35 is fixed to the rocking lever 25 with its profile being eccentric with respect to the axis of the support shaft 26 which is pivotally provided with the rocking lever 25 rockable in association with the rotation of the main crank shaft 21, and a shaft 43 is inserted at its one end into the main body of the apparatus, while it is rotatably and slidably inserted into a bearing portion formed at its end on the opposite side of the main lever 2*a*. As illustrated in FIG. 10, on the opposite side of the end of the shaft 43 rotatably attached to the main body of the apparatus, there is fixedly provided a lever 44 having a cam follower 44*a*, with the cam follower 44*a* being fixed in abutment upon the periphery of the taper cam 35 by the strut 6, so that the shaft 43 can be repeatedly rotated in association with the rocking of the taper cam 35.

Fixed to the shaft 43 rotating in association with the movement of the taper cam 35, a lever 45 of extended length is provided at its extreme end with a protuberant engaging piece 5*a* which projects toward an adjacent main lever 47*aa* to be described later. The engaging piece 45*a* is engaged with a stroke controlling block 46*a* moved by the operation of an adjust screw 46*b* along a second lever 46 pivotally attached to a shaft 56 fixed to the main body of the apparatus until it is located and held at a given position. The stopping lever 18*a* is engaged at its one end with the pitching lever 14 through a pivotal portion pivotally attached to the shaft 18*c* of the main body of the apparatus, and is provided at the opposite end with a through-hole 18*aa*, which is adapted to receive a connecting rod 20 to be described just below. This connecting rod 20 is threadedly provided with an adjust screw 20*a* having an outer diameter larger than the inner diameter of the through-hole 18*aa*, and is pivotally connected to the second lever 46, while it is inserted through the through-hole 18*aa*.

In substantially the same manner as the conventional apparatus, a bending die moving mechanism 55 is provided to move the bending die 53 during the production of the coiled spring, with which the wire fed out by the rotation of the feed rollers 39 is engaged. As illustrated in FIG. 11, this bending die moving mechanism 55 comprises a holding part for holding the bending die 53 and an operating part for moving the holding part. The holding part is supported by a shaft 54*b* in which a die holder 54 holding the bending die 53 is fixedly inserted through a central portion of a slide 54*a*. This slide 54*a* is constantly urged in the right-handed direction in FIG. 11 with respect to the main body of the apparatus by the spring force of a spring 51, and is limited with respect to its position by an adjust screw 52 threadedly attached to the main body of the apparatus. The operating part comprises a connecting rod 49 following a follower 47*a* of a cam unit 47 for the bending die 53 and a substantially L-shaped lever 50 fixed at its central portion to a shaft 57 rotatably attached to the main body of the apparatus, provided at its one end with a through-hole receiving the connecting rod 49, and facing at its other end on the right side of the shaft 54*b* of the slide 54*a*. A cam 47*b* of the cam unit 47 of this operating part is so fixed to the cam shaft 3 that it can rotate in synchronism with the pitch cam 4 of the cam unit 1 for operating the pitch tool 17. Then, the follower 47*a* of the cam unit 47 is rotatably supported on the main body of the apparatus by a shaft 47*ac* integral with a main lever 47*aa* having a cam follower 47*ab* mounted to its extreme end. Rocked by the main lever 47*aa* following the cam 47*b* of the cam unit 47, a second lever 48 is pivotally attached to a shaft 56 fixed to the main body of the apparatus, while it is connected at its extreme end with the connecting rod 49. The second lever 48 is provided with a stroke controlling block 48*a* which abuts upon the main lever 47*aa* in a longitudinally slidable manner, said block 48*a* being in turn provided with a position adjust screw 48*b*. The connecting rod 49 connected to the second lever 48 receives threadedly at its extreme end an adjust screw 49 to adjust the spacing between the end of the substantially L-shaped lever 50 having the connecting rod 49 inserted through it and a junction 49*b* of the connecting rod 49 to the second lever 48. Turning this adjust screw 49*a* right causes the spacing between the end of the lever 50 and that junction 49*b* to be made narrow and, at the same time, the bending die 53 to be forced out, left in FIG. 11, against the spring force of the spring 51 until it reaches the position at which the desired coil diameter is obtained. While reference has been made to the bending die moving mechanism substantially similar to that of the conventional apparatus, it is understood that if a knob 43*a* located at the rear end of the shaft 43 is pulled in, as shown by a dash-two dot line, then the lever 45 of extended length is disengaged away from the adjacent main lever 47*aa*. In order to maintain disengagement or engagement, a lock mechanism 43*b* is provided to lock the shaft 43 in place. Such a bending die moving mechanism 55 capable of moving the bending die 53 during the production of the coiled spring is put in operation when making a tapered compression coiled spring. In other words, the mechanism 55 is so operated that if the lever 44 and lever 45 of extended length are fixedly joined to the shaft 43 with the lever 45 in engagement with the main lever 47*aa*, then the shaft 43 can be rotated by the rocking of the lever 44 following the taper cam 35, while the lever 45 of extended length can be rocked at the same speed during the supply of the wire. As shown in FIGS. 10 and 11, the engaging piece 45*a* of the lever 45 of extended length serves to bring the lever 45 in engagement with the main lever 47*aa* adjacent to it. However, the main lever 47*aa* is so designed that it can follow the cam 47*b* of the cam unit 47 within its given angular range and rock independent of the rocking of the lever 45 of extended length.

Reference will now be made to the operation of the apparatus of the invention for making coiled springs, which is best-suited for carrying out the inventive method.

In order to make coiled springs according to the method of this invention, the motor is first driven to actuate the main crank shaft 21 of the inventive apparatus. Before that, however, the main crank shaft 21 has to be manually rotated to provide a general regulation to the respective parts with the shape and size of the coiled spring to be produced in mind. Then, the motor is actuated to rotate the main crank shaft 21 to provide a final regulation of the respective parts of the compression coiled springs to be produced in consideration of variations etc. of the wire material during the production process, followed by the initiation of production.

Referring first to the regulation and operation of the respective parts of the feed roller rotating mechanism, the rocking lever 25 with the roller 22*a* inserted in the guide groove 25*a* is rocked around the support shaft 26 at a given angle by the rotation of the roller 22*a* rotatably attached to the crank disk 22 in association with the rotation of the main crank shaft 21. In this case, the momentum of the shaft 27*a* provided at the extreme end of the second lever 27 is determined by the position at which the roller 27*b* fitted onto the end of the shaft 27*a* fixedly connected to the extreme end of the second lever, which is rotatable around the shaft 33*a*, is engaged within the guide groove 25*b* in the rocking lever 27. This can in turn determine the stroke of a repeated movement of the rack 31, thereby determining the length of the wire to be supplied. The second lever 27 can freely be moved along the guide groove 25*b* in the rocking lever 25 rocked at the above-mentioned given angle by regulating the position of the shaft 27*a* provided at the extreme end of the second lever 27 defining the fulcrum. Thus, it is possible to regulate the stroke of the repeated movement of the rack 31 whether the apparatus is in operation or not and so to provide a free variation of the length of the wire to be fed out, while the times of initiation and termination in feeding the wire fed to the pitch cam 4 of the rotating cam unit are always kept constant.

When the length of the wire to be fed out is regulated by the adjust screw 34, the pitch tool 17 stays at the reference position for a while after the initiation of wire feeding, so that the wire is coiled in a non-pitched state, forming the leading seat turn of the compression coiled spring to be produced. However, when the follower 2 of the cam unit 1 moves along the contour of the cam pitch 4, which rotates counterclockwise in FIGS. 1 and 5, and comes close to the base circle of the pitch cam 4 by the force of the spring 12 (downwardly in FIGS. 1 and 5), the main lever 2*a* moves downwardly behind the main lever 2*b*. While the second lever 10 follows the main lever 2*a*, the connecting rod 11 and the adjust screw 11*a* in threaded engagement with it begin descending. Then, the adjust screw 11*a* comes in engagement with the pitching lever 14, and the pitch tool 17 attached to the pitching lever 14 extends, initiating pitching. The main levers 2*a* and 2*b* moves downwardly along the contour of the pitch cam 4, causing a further extension of the pitch tool 17. The pitch tool 17 is stopped by the stopper 18 of the stopping lever 18*a* located below the orbit in which the end of the pitching lever 14 moves. In this state, given pitching is continued. In this case, the second lever 10 is stopped, and the main levers 2*a* and 2*b* are spaced away from the stroke controlling block 10*a* of the second lever 10. As coiling proceeds further, the follower 2 is spaced away from the base circle of the cam pitch 4 along its contour (upwardly in FIGS. 1 and 5). At this time, the main lever 2*b* moves upwardly ahead of the main lever 2*a*, so that the second lever 10 begins pushing up the connecting rod 11 and adjust screw 11*a* against the force of the spring 12. Following this, the pitching lever 14 is spaced away from the stopper 18 by the force of the spring 15, beginning to pull back the pitch tool 17 to the reference position. As the pitch tool 17 is further retracted along the contour of the pitch cam 4 to the reference position, so that the pitching lever 14 is stopped by engagement with the stopper 16. Thus, pitching is completed. However, the adjust screw 11*a* still continues to ascend, and returns to the original position when the cam follower 2*b* of the main lever 2*b* contacts the outer periphery of the pitch cam 4. Meanwhile, the trailing seat turn of the coiled spring being produced is formed with wire feeding being completed. Thus, the regulation of pitching of the compression coiled spring is carried out by turning the adjust screw 19 to move the position of the stopper 18 of the pitching lever 18*a*, thereby determining the amount of pivotal movement of the pitching lever 14.

This is because the connecting rod 11 is located at the lowermost position where the pitch tool 17 extends to the predetermined position for pitching. In this case, the adjust screw 20*a* is loosened so as to prevent a connecting rod 20 for ununiform pitching from having an adverse influence upon it.

The amounts of both seat turns of the compression coiled spring is regulated by turning the adjust screw 11*a* to vary a distance between the upper end of the pitching lever 14 and the lower end of the adjust screw 11*a*, thereby determining the time when the pitch tool 17 is to be extended or retracted. This mechanism is particularly effective for producing taper compression coiled springs. The reason is that only the amount of the trailing seat turn can be adjusted by turning the adjust screw 9*b* disposed adjacent to the second lever 10 to move the main lever 2*b*, thereby varying the timing when it is to engage the pitch cam 4.

The squareness of the leading seat turn of the compression coiled spring is regulated by turning the stroke controlling block 10*a* of the second lever 10 disposed in contact with the main lever 2*a* by means of the adjust screws 10*b*, 10*b*, while the squareness of the trailing seat turn of the compression coiled spring is adjusted by turning the stroke controlling block 10*a* of the second lever 10 disposed in contact with the main lever 2*b* by means of the adjust screw 10*b*. In other words, when the stroke controlling block 10*a* is moved towards the connecting rod 11, the rate of the pitch tool 17 to be extended or retracted becomes low. When the stroke controlling block 10*a* is spaced away from the connecting rod 11, on the contrary, the rate of the pitch tool 17 to be extended or retracted becomes high. Hence, the squarenesses of both seat turns can be regulated individually.

When producing unevenly pitched compression spiral springs or evenly pitched taper compression spiral springs, the position of the stopper 18 of the stopping lever 18*a* for determining the extension of the pitch tool 17 is first regulated at the end opposite to the stopper 18 by means of the adjust screw 20*a*. It is here preferable to prevent the adjust screw 19, used for producing straight compression helical spring, from having an influence upon such regulation. At this time, the force of the spring 18*b*, under which the stopping lever 18*a* is placed, is transmitted to the lever 44 via the stopping lever 18*a*, connecting rod 20, second lever 46 and continuous lever 45, so that the cam follower 44*a* of the lever 44 is in engagement with the taper cam 35. As the crank spindle 21 rotates in this state, the taper cam 35 follows the pivotal movement of the rocking lever 25 in engagement with the roller 22*a* of the crank disc 22 fixed to the crank shaft 21 and rotates around the rocking lever 25 by a given amount of angle. At the same time, the cam follower 44*a* of the lever 44 is vertically displaced, as in FIG. 1, along the contour of the taper cam 35, which is in an eccentric state. The connecting rod 20 is then vertically displaced through the lever 45 and second lever 46, causing movement of the stopping lever 18*a* fixed in place by the adjust screw 20*a* of the connecting rod 20. In other words, when the rocking lever 25 of the crank mechanism rocks upwardly in FIG. 1 (when wire feeding does not take place), the lever 44 is forced up along direction of the rocking movement of the taper cam 35. With this, the stopping lever 18*a* is let down to the position, shown by a solid line, by the adjust screw 20*a* of the connecting rod 20. Then, the rocking lever 25 is pivotally let down to produce the coiled spring. In the meantime, the stopping lever 18*a* is returned to the original position, shown by a broken line, while letting the adjust screw 20*a* of the connecting rod 20 up by the force of the spring 18*b*. By that amount, the pitch tool 17 is thus extended. In this manner, the position, to which the pitch tool 17 extends, can be moved during pitching. At this time, the leading pitch is determined by the position of the pitch tool 17 initially determined by the adjust screw 20*a* of the connecting rod 20, and the trailing pitch is determined by the rate of movement of the pitch tool 17 depending upon the amount of movement of the connecting rod 20 adjusted by the stroke controlling block 46*a* of the second lever 46. In other words, the pitch of the compression spiral spring to be produced is linearly enlarged toward the trailing end. Extent of the enlargement is adjusted by turning the adjust screw 46*b* to move the stroke controlling block 46*a*. When producing a taper compression spiral spring, the grip 43*a* of the shaft 43 is manually moved prior to the initiation of production, as illustrated in FIG. 10, thereby positioning the engaging piece 45*a* of the continuous lever 45 such that it can be in engagement with the main lever 47*aa* of the cam unit 47 for the bending die. Then, the bending die 53, so positioned that a leading coiled portion of a small diameter is formed, is such that it is movable by turning the adjust screw 52 to the position at which a trailing coiled portion of a large diameter is formed. Now, the force of the spring 51 giving a push to the slide 54*a* and holding the bending die 53 acts via the shaft 54*b*, lever 50, adjust screw 49*a*, connecting rod 49 and second lever 48 to engage the cam follower 47*ab* of the main lever 47*aa* with the cam 47*b* of the cam unit 47 for the bending die. In FIG. 11, the position of rotation of the cam 47*b* shows the point of time when coiling is completed. The time for initiating wire feeding is in coincidence with the time when the cam 47*b* is so rotated counterclockwise that the follower 47*a* is about to move along the contour of the cam 47*b* from its outer periphery toward its base circle (upwardly in FIG. 11). Then, the engaging piece 45*a* of the continuous lever 45 operated by the taper cam 35 fixed to the rocking lever 25 is engaged with the main lever 47*aa* from above. After that, the rocking movement of the follower 47*a* of the cam unit 47 remains restricted by the engaging piece 45*a* of the lever 45 until the formation of the trailing seat turn is completed, as described later. Then, the formation of the taper compression spiral coil is initiated, and the bending die 53 is spaced away for the core 41 along the rocking movement of the taper cam 35, as the trailing end is approached. Then, the operation of the main lever 47*aa* is restricted by the cam 47*b* just before the formation of the trailing seat turn of the taper compression spiral spring is completed, so that it is spaced away form the engaging piece 45*a* of the lever 45, letting the second lever 48 down. The connecting rod 49 is then let down to immediately return the bending die 53 to the position shown in FIG. 11, while it is pushed by the lever 50. The degree of tapering amount is determined by moving the stroke controlling block 48*a* of the second lever 48 by the adjust screw 48*b*.

The continuous lever 45, on the one hand, is engaged at the engaging piece 45*a* with the main lever 47*aa* in the process for forming taper compression spiral springs to determined the position of the bending die 53 and on the other hand, is brought in abutment against the stroke controlling block 46*a*, as illustrated in FIGS. 1 and 2, to determine the position of the stopper 18 at the end of the stopping lever 18*a* via the second lever 46 and connecting rod 20, thereby making the pitch of the taper coiled spring uniform.

The process for making coiled springs according to this invention, as described above in greater detail, has various advantages as recited below and makes a great contribution to the coil-making field.

(1) According to this invention, as the follower of the cam unit moves toward the base circle of the pitch cam, it permits the pitch tool to be extended to the predetermined position by the spring force for pitching. After that, as the follower of the cam unit moves away from the base circle of the pitch cam, the pitch tool is retracted to complete pitching. It is thus possible to regulate the amounts, squareness and pitches of the leading and trailing seat turns of coiled springs as well as the total number thereof (the length of a wire to be fed out) without interfering with each other and, hence, to regulate one part for each regulation. Thus, quick arrangements can be made easily even by nonexperts, thus making it possible to make coiled springs of high accuracy.

(2) The position to which the pitch tool is extended—a factor having the greatest influence on the loading characteristics of compression coiled springs—is determined by the stopper. It is thus possible to make coiled springs of high accuracy at a high rate of production and in a stable manner, while preventing a jumping-up of the follower due to an impactive contact of the pitch cam with the follower.

(3) Since the operation of the pitch tool is restricted by the stopper, the extention or retraction of the pitch tool—a factor having the greatest influence of the squareness of coiled springs—can be effected along a curve of uniform motion defined on the contour of the pitch cam which is quite the same on the leading and trailing sides. It is thus very easy to regulate the squareness of the seat turn.

(4) The regulation of the amounts of the seat turns of coiled springs, the squareness of the seat turns, the pitches of the coiled springs, the length of the wire to be fed out, the diameters of the coils, etc. can be performed without replacing the pitch cam, regulating the position of the pitch cam or processing the contour of the pitch cam such as cutting a part thereof and even in the process of making the coiled springs at a given rate of production. In addition, the adjust screws are all located on the outside of the apparatus. Thus, the apparatus is operated very easily so that regulation can be preferred depending upon the actual conditions of production and even in a state where a motor is actuated at the arrangement stage to form compression springs continuously. Therefore, the efficiency of the apparatus is very high.

(5) The amount of the pitch tool to be extended can be regulated at a given ratio and on continuous basis in the process of making coiled springs. The pitch of coiled springs, whether uniformly or ununiformly pitched straight or taper type, can immediately be regulated only by turning the adjust screws. This is very advantageous in producing the coiled springs required to stand up to two- or three-stage loading.

(6) Even when there is a variation in the length of the wire to be fed out, when wire feeding to the pitch cam of the rotating cam unit is initiated or terminated always remains constant. In addition, since the length of the wire to be fed out can be varied by turning the adjust screws irrespective of the apparatus being or being not in operation. Thus, it is very easy to regulate the shape and size of coiled springs.

(7) When the pitch cam is formed of a single material, the apparatus is of a simple and inexpensive structure, and can produce various compression coiled springs without any replacement of the pitch cam, offering an economical advantage. When the pitch cam is divided into two parts, it is possible to reduce the amounts of motion of the follower, main lever, second lever, connecting rod, adjust screws, etc. following the pitch cam and, hence, for workers to do the work under very quiet conditions and with greater safety. In addition, the two-split pitch can be easily regulated only by adjusting the graduated dial. Prior to arrangements, the total number of turns of the coiled springs to be produced may thus be fixed at a value slightly larger than required. Smaller turns may freely be formed and have no adverse influence upon the efficiency of work.

(8) The apparatus is very easy to handle, since the adjust screws for regulating the amounts of coiled springs, the squareness of the seat turns, the coil pitch and the length of the wire to be fed, to say nothing of the coil diameter of the coiled springs, are all located on the outside of the apparatus.

What is claimed is:

1. An apparatus for making coiled springs, comprising: a cam unit including a pitch cam, a connecting rod following a follower of said cam unit, a spring for exerting a spring force to engage the follower of said cam unit with the pitch cam, a pitch tool extendible from a reference position to a predetermined position through a turning of a pitching lever to determine the pitch of the coiled spring to be formed, a spring for constantly exerting a spring force to retract said pitch tool, stoppers for separately restricting movement of said pitch tool to the predetermined position to which it is extended or to the reference position, and a roller rotating mechanism for intermittently rotating feed rollers at a given angle in a certain direction, said rollers feeding a wire to a bending die positioned in front of said pitch tool.

2. An apparatus as claimed in claim 1, wherein said roller rotating mechanism comprises rollers located on a rotating crank disc, a rack with a fulcrum which is movable along a guide groove formed in a rocking lever rocking around a pivotal shaft thereof and in a certain angular range in association with the rotation of said rollers around a crank spindle of said crank disc, a second lever movable toward or away from the pivotal shaft of said rocking lever for moving the fulcrum of said rack, a one-way clutch for transmitting the force of rotation of a pinion in mesh with said rack in one direction alone and a gear for transmitting the force of rotation of said one-way clutch to said feed rollers.

3. An apparatus as claimed in claim 2, which further includes stopper carrier means to reciprocating the stopper for restricting the pitch tool to the predetermined position to which it is extended in synchronism with the rocking lever rocked at a given angle by rotation of the crank disc of the feed roller rotating mechanism.

4. An apparatus as claimed in claim 3, wherein the pitch cam of the cam unit is divided into two parts each with an inner gear, said inner gears being in mesh with pinions which are supported by a cam holder fixed at its both ends to a cam shaft and are in mesh with each other.

5. An apparatus as claimed in claim 4, wherein the follower of the cam unit is divided into two parts in the axial direction of the pitch cam. with the rocking lever rocked at a given angle by rotation of the crank disc of the feed roller rotating mechanism.

6. An apparatus as claimed in claim 5, wherein the follower of the cam unit divided into two parts in the axial direction of the pitch cam of the cam unit is engaged with said pitch cam at a given position and each part follower the cam unit at a different timing.

7. An apparatus as claimed in claim 6, wherein at least one part of the follower of the cam unit divided into two parts is provided with means for regulating a variation in the timing when the other follower is engaged with the pitch cam.

* * * * *